United States Patent [19]

Sekiya et al.

[11] 4,245,338

[45] Jan. 13, 1981

[54] TIME CORRECTION SYSTEM FOR AN ELECTRONIC TIMEPIECE

[75] Inventors: Fukuo Sekiya, Tokorozawa; Takashi Yamada, Sayama, both of Japan

[73] Assignee: Citizen Watch Company Limited, Tokyo, Japan

[21] Appl. No.: 958,579

[22] Filed: Nov. 7, 1978

[30] Foreign Application Priority Data

Nov. 10, 1977 [JP] Japan ..... 52/134111
Nov. 25, 1977 [JP] Japan ..... 52/140737

[51] Int. Cl.[3] ..... G04C 9/00

[52] U.S. Cl. ..... 368/188; 368/187; 368/185; 368/72

[58] Field of Search ..... 58/23 R, 23 D, 85.5, 58/4 A, 39.5; 368/187, 185, 72

[56] References Cited

U.S. PATENT DOCUMENTS

| | | | |
|---|---|---|---|
| 3,911,665 | 10/1975 | van Berkum | 58/4 A X |
| 4,059,955 | 11/1977 | Prak | 58/85.5 X |
| 4,067,187 | 6/1978 | Sekiya et al. | 58/85.5 X |
| 4,089,159 | 5/1979 | Yoshida | 58/4 A X |
| 4,142,361 | 3/1979 | Kimura | 58/85.5 X |

*Primary Examiner*—Ulysses Weldon
*Attorney, Agent, or Firm*—Jordan and Hamburg

[57] ABSTRACT

An electronic timepiece having improved means for rapid setting of time, date or alarm time, whereby the number of setting pulses generated for each actuation of an external actuating member is varied depending upon the time intervals between successive actuations.

12 Claims, 6 Drawing Figures

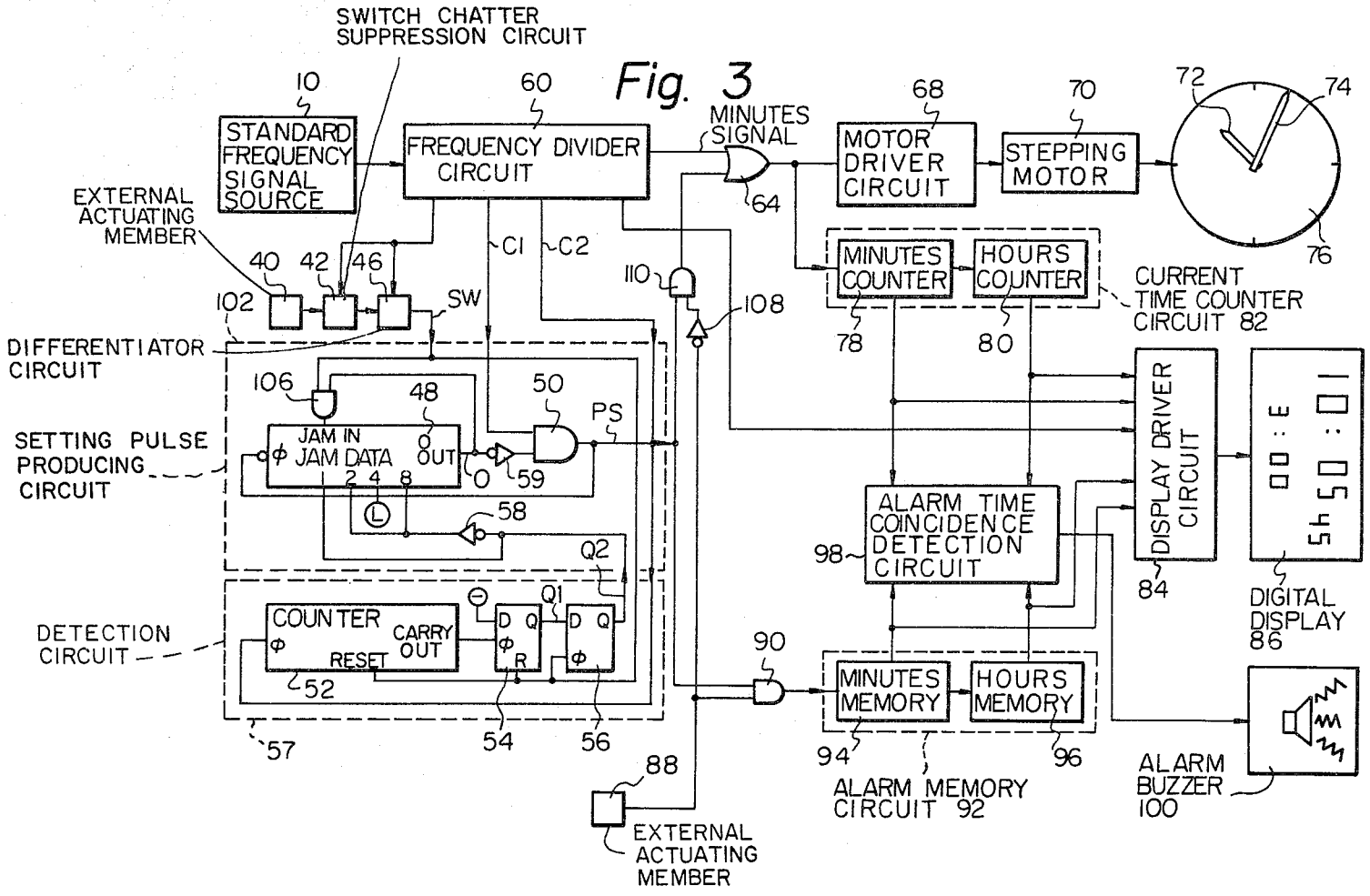
Fig. 3
STANDARD FREQUENCY SIGNAL SOURCE
FREQUENCY DIVIDER CIRCUIT
MOTOR DRIVER CIRCUIT
STEPPING MOTOR
MINUTES SIGNAL
SWITCH CHATTER SUPPRESSION CIRCUIT
EXTERNAL ACTUATING MEMBER
DIFFERENTIATOR CIRCUIT
SETTING PULSE PRODUCING CIRCUIT
DETECTION CIRCUIT
CURRENT TIME COUNTER CIRCUIT 82
MINUTES COUNTER
HOURS COUNTER
DISPLAY DRIVER CIRCUIT
DIGITAL DISPLAY 86
ALARM TIME COINCIDENCE DETECTION CIRCUIT
ALARM MEMORY CIRCUIT 92
MINUTES MEMORY
HOURS MEMORY
ALARM BUZZER 100
EXTERNAL ACTUATING MEMBER
JAM IN
JAM DATA
OUT
COUNTER
CARRY OUT
RESET
10 : 05 45
3 : 00

TIME CORRECTION SYSTEM FOR AN ELECTRONIC TIMEPIECE

This invention relates to electronic timepieces, and in particular to a circuit whereby setting of time, date or alarm time by the timepiece user can be rapidly and conveniently performed, due to the number of setting pulses generated by each setting operation being determined by the rapidity with which the timepiece user successively performs setting actuations.

In any type of electronic timpiece, it is necessary to provide some means whereby the timepiece user can adjust the current time or date being displayed by the timepiece, or can set in an alarm time. In one conventional method of performing such setting, the timepiece user successively actuates an external operating member, and each actuation causes the quantity being set to be advanced by one unit. For examle, if the minutes of current time are being set, then each actuation of the external operating member used for setting causes the minutes displayed by the timepiece to be advanced by one minute. Thus, it may be necessary for the timepiece user to actuate the external operating member up to 59 times successively in order to perform setting of the minutes. Similarly, when setting a date of the month, it may be necessary for the timepiece user to actuate an external operating member up to 30 times in succession.

One method which has been proposed to reduce the number of actuations required for time setting has been to set the tens and units of the quantity to be set separately. In other words, the units of the quantity are first selected for setting, and the necessary number of actuations performed. The tens of the quantity (for example the tens of minutes) are then selected, and are set. However this method is troublesome to the timepiece user, and leads to increased circuit complexity or additional external actuating members.

With a setting circuit in accordance with the present invention, these disadvantages of the prior methods are overcome. Only a single external actuating member is required to set both the units and tens of a quantity such as minutes, hours, date, etc. This is accomplished by making the number of setting pulses which are generated as a result of each actuation of the external operating member depend upon the time interval between each of the actuations, i.e. the number of setting pulses generated by each actuation depends upon the rate at which the timepiece user successively actuates the external member. Thus, in the initial steps of setting a certain quantity, setting can be advanced rapidly by the timepieces user actuating the external member in rapid succession. When the desired value has almost been reached, then the timepiece user can actuate the external member at longer intervals, so that a finer degree of control of setting can be obtained.

It is therefore an object of the present invention to provide circuit means whereby setting of an electronic timepiece can be more rapidly and conveniently accomplished than has hitherto been possible.

More particularly, it is an object of the present invention to provide circuit means whereby the number of setting pulses produced by each actuation of an external actuating member is made dependent upon the rate at which said external operating member is successively actuated.

Further objects, features and advantages of the present invention will be made more apparent from the following description, when taken in conjunction with the attached drawings, whose scope is given by the appended claims.

In the drawings:

FIG. 3 is a simplified block diagram of an embodiment of an electronic timepiece for simultaneous analog and digital display of time information, having an alarm function, and incorporating a time setting circuit in accordance with the present invention;

Figure 1:
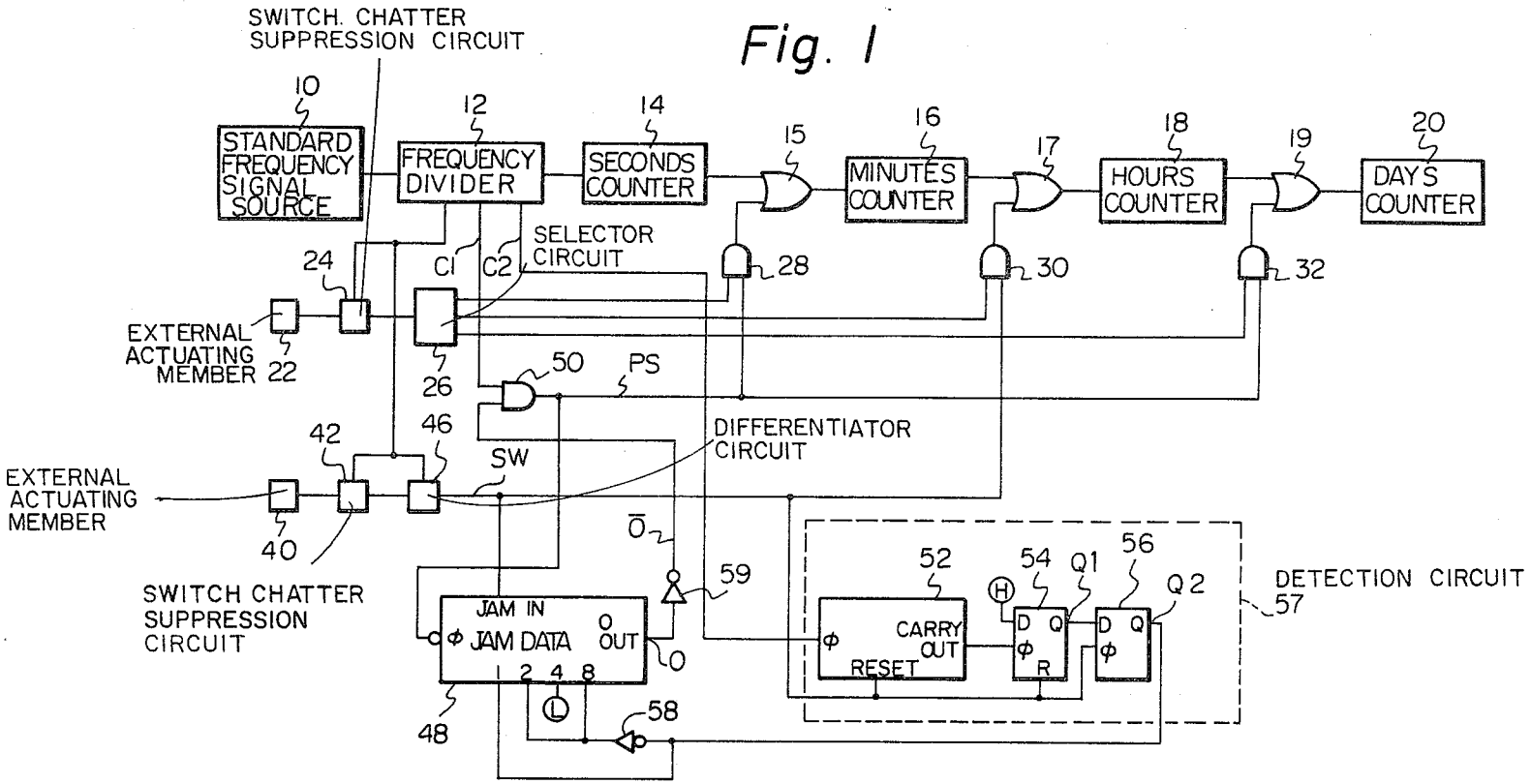
FIG. 1 is a simplified block diagram of an embodiment of an electronic timepiece for digital display of time, incorporating a time setting circuit according to the present invention.

Referring now to the drawings, FIG. 1 shows a block diagram of an electronic timepiece suitable for display of time information in digital form by an electro-optical display incorporating a setting circuit in accordance with the present invention. For simplicity of description, the means of displaying the time information are omitted from FIG. 1. Numeral 10 indicates a source of a standard high frequency signal, which is applied to a frequency divider 12. The output signal from frequency divider 12 is applied to a seconds counter 14, which produces an output signal consisting of a train of pulses indicative of one minute. This signal is applied to a minutes counter 16 through an OR gate 15. Minutes counter 16 produces an output signal having a period of one hour which is applied through OR gate 17 to an hours counter 18. The output from hours counter 18 is applied to days counter 20 through OR gate 19.

Numeral 22 indicates an external actuating member coupled to a switch, used to select setting of either minutes counter 16, hours counter 18 or days counter 20. Each time actuating member 22 is actuated, a pulse is generated which is applied through a switch chatter suppression circuit 24 to a selector circuit 26. Successive actuations of actuating member 22 cause output lines from selector 26 connected to input terminals of AND gates 28, 30 and 32 to be successively brought to the logic high level potential (referred to hereinafter as the H level). Thus, the output from AND gate 50, which consists of setting pulses PS to be described later, can be applied through the AND gate (28, 30 or 32) corresponding to the counter which has been selected for setting.

Figure 2:
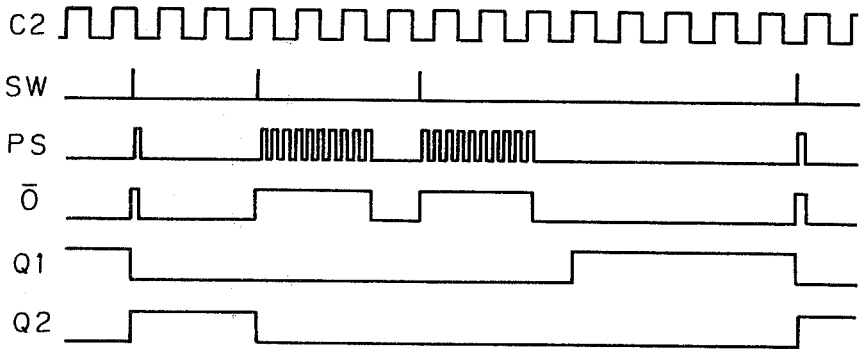
FIG. 2 is a waveform diagram illustrating the operation of the time setting circuit in the embodiment of FIG. 1.

Numeral 40 indicates an external actuating member coupled to a switch, collectively referred to hereinafter as actuating member 40, and used to perform setting of new contents into the counter which has been selected for setting by actuation of actuating member 22. Each time actuating member 40 is actuated, a switch coupled thereto is caused to generate a pulse, which is applied through switch chattering suppression circuit 42 to a differentiator circuit 46. Differentiator circuit 46 produces a single pulse of extremely narrow width for each pulse which is input to it. These differentiated pulses, which will be referred to hereinafter as actuating pulses, are designated as SW in FIG. 1, and are applied to the JAM IN terminal of a down counter 48, as well as to the reset terminal of data type flip-flop 54, the clock terminal of data type flip-flop 56, the reset terminal of a divide-by-N counter 52, and one input of AND gate 30. For the circuit embodiment of FIG. 1, counter 52 is a divide-by-four counter, i.e. its Carry Out terminal goes from the L level to the H level after four successive clock pulses have been input to it, starting from the reset state. Counter 52, and data type flip-flops 54 and 56 constitute a detection circuit 57, which serves to detect the duration of the time intervals between successive differentiated actuating pulses SW. The operation of detection circuit 57 will be described with reference to the timing chart of FIG. 2. Signal C2, consisting of a pulse train of relatively low frequency, is supplied from frequency divider circuit 12 to the clock terminal of divide-by-four counter 52. We shall assume as an initial state that output Q1 of data type flip-flop 54 is at the H level, while output Q2 of data type flip-flop 56 is at the L level, as shown in FIG. 2. If now actuating member 40 is actuated, then an actuation pulse SW will be applied to the reset terminal of divide-by-four counter 52, and to the clock terminal of flip-flop 56 causing the H level of signal Q1 to be read into flip-flop 56, so that output Q2 goes to the H level. Since the SW pulse is also applied to the reset terminal of flip-flop 54, output Q1 goes to the L level immediately after output Q2 goes to the H level. If now, as shown in FIG. 2, the next SW actuation pulse is applied before four successive C2 pulses have been applied to the clock terminal of counter 52, then this next SW pulse will rest flip-flop 54 so that output Q1 goes to the L level, as well as resetting divide-by-four counter 52 so that no transition occurs at the Carry Out terminal of counter 52. Subsequently, so long as the interval between actuation pulses SW is less than the duration of four successive C2 pulses, then output Q1 will remain at the L level, and therefore, Q2 will also remain at the L level.

If now the interval between two successive actuation pulses is made longer, as shown by the third and fourth SW pulses in FIG. 2, then the Carry Out terminal of divide-by-four counter 52 will go from the L level to the H level. Since the data input terminal of flip-flop 54 is connected to the H level, output signal Q1 will go to the H level at this time, and will remain at this level until the next SW pulse is applied. This next SW pulse will also read the H level of signal Q1 into flip-flop 56, before resetting Q1 to the L level, so that signal Q2 now goes to the H level as shown at the right-hand side of FIG. 2. Thereafter, so long as the interval between successive actuations of actuating member 40 is greater than the duration of four successive C2 pulses, then output Q1 will always go to the H level between successive SW pulses before being reset to the L level. In this condition therefore, output Q2 will remain at the H level continuously.

From the above description it will be apparent that detection circuit 56 produces an output signal Q2 which remains at the L level so long as the time intervals between successive actuations of external actuating member 40 are shorter than a predetermined value (determined by the division factor of counter 52 and the frequency of signal C2), while output signal Q2 goes to the H level if the time intervals between successive actuations of external actuating member 40 are longer than said predetermined value.

Output Q2 is used as a control signal to control a setting pulse generator circuit, consitituted by a down counter 48, inverter 58, AND gate 50 and inverter 59. Counter 48 features a JAM IN terminal and four JAM DATA terminals. If a pulse is applied to the JAM IN terminal, then the combination of logic levels applied to the JAM DATA terminals is stored in counter 48 and the 0 OUT terminal of counter 48 goes to the L level. The JAM DATA terminals are assigned weighting factors, of 1, 2, 4 and 8 respectively. The 0 OUT terminal remains at the L level until a number of pulses has been applied to the clock terminal which is equal to the binary number represented by the stored JAM DATA inputs, and then returns to the H level.

If now actuating member 40 is actuated at a relatively low repetition rate, then as described above, output Q2 will be at the H level. In this case, since the JAM DATA terminal of weight 4 in down counter 48 is held at the L level, and since output Q2 is applied to the 8 and 2 weight JAM DATA TERMINALS through inverter 58, each actuting pulse SW causes a value of 1 to be stored in down counter 48. When an SW pulse is applied, the 0 OUT terminal goes to the L level, so that the output of inverter 59 goes to the H level, thereby enabling AND gate 50. Signal C1 consists of a train of pulses having a higher frequency than C2, and is applied to an input of AND gate 50. An output pulse is therefore produced from AND gate 50 at this time, which is applied to the clock input terminal of down counter 48, as well as to inputs of AND gates 28 and 32 as a PS setting pulse. Since a value of one has been stored in down counter 48 from the JAM DATA terminals, the 0 OUT terminal of down counter 48 will go to the H level after one pulse has been applied to the clock input terminal. The output of inverter 59 therefore goes to the L level, inhibiting AND gate 50, so that further PS pulses are not output from AND gate 50. In this case therefore, a single PS setting pulse is applied to AND gates 28 and 32 as a result of each actuation of actuating member 40, so that the selected counter 16 or 20 is advanced by one unit. The selected counter can thus be set with new contents in a gradual and precise manner. The contents of hours counter 18 is corrected in response to the signal SW applied through AND gate 30.

If, on the other hand, the timepiece user actuates external actuating member 40 in rapid succession, then as described previously, output Q2 will be at the L level. As a result, L level signal will be applied to the JAM DATA terminals of weights 1 and 4, while H level inputs will be applied to the JAM DATA terminals with weights 8 and 2. In this case therefore, the combination of inputs applied to the JAM DATA terminals corresponds to a value of 10, and this value is read into down counter 48 by SW pulses, as exemplified by the second SW pulse from the left shown in FIG. 2. Again, the 0 OUT terminal of down counter 48 goes to the L level, so that the output of inverter 59 goes to the H level, enabling AND gate 50 to apply PS pulses to the clock input terminal of down counter 48 and to inputs of AND gates 28 and 32. When ten pulses have been applied to the clock terminal of down counter 48, then since a value of 10 has been stored therein from the JAM DATA inputs, the 0 OUT terminal will go to the H level, so that the output of inverter 59 goes to the L level, as shown in FIG. 2. Thus, when external actuating member 40 is actuated in rapid succession, each actuation causes ten PS setting pulses to be output from AND gate 50 and applied through AND gate 28 or 32 to the minutes or days counter which has been selected for time setting. In this case therefore, setting can be advanced rapidly and conveniently.

Another embodiment of an electronic timepiece incorporating a setting circuit in accordance with the present invention will now be described with reference to FIG. 3. In FIG. 3, numeral 10 designates a source of a high frequency standard signal which is applied to a frequency divider circuit 60. Frequency divider circuit 60 performs frequency division of the high frequency standard signal from source 10, and produces an output signal having a period of one minute, which is applied to an input of OR gate 64. Frequency divider circuit 60 also produces a signals C1 and C2, which consist of pulse trains as in the case of the circuit embodiment of FIG. 1 described above. The output of OR gate 64 is applied to a motor driver circuit 68, which drives a stepping motor 70. Stepping motor 70 is coupled to hours hand 72 and minutes hand 74 of a timepiece dial, to display time information in analog form. The output of OR gate 64 is also applied to a minutes counter 78, whose output is applied to an hours counter 80, in current time circuit 82. Thus, the contents of current time counter circuit 82 are advanced in synchronism with stepping motor 70. The output of minutes counter 78 and hours counter 80 are applied through display driver circuit 84 to a digital display 86. The current time information which is displayed in analog form by timekeeping hands 72 and 74 is therefore also displayed in digital form by means of digital display 86, simultaneously.

Numeral 88 indicates an external actuating member coupled to a switch, which produces a setting selection signal. This is an H level signal when the actuating member is in a first position, and an L level signal when the acuating member 88 is in a second position.

When actuating member 88 is actuated to generate an H level setting selection signal, AND gate 90 is enabled to apply setting pulses PS to an alarm memory circuit 92, and AND gate 110 is inhibited by the L level output of inverter 108. When actuating member 88 is actuated to generate an L level setting selection signal, then AND gate 110 is enabled to pass setting pulses to OR gate 64, and AND gate 90 is inhibited. Alarm memory circuit 92 comprises a minutes memory circuit 94 and an hours memory circuit 96 which receives the output of the minutes memory circuit 94. The output of alarm memory circuit 92 is applied through display driver circuit 84 to digital display 86, so that the contents of alarm memory circuit 92 are displayed in digital form.

The outputs of current time counter circuit 82 and of alarm memory circuit 92 are applied to an alarm time coincidence detection circuit 98, which produces an alarm coincidence signal when coincidence is detected between the contents of current time counter circuit 82 and of alarm memory circuit 92. This alarm coincidence signal from alarm time coincidence detection circuit 98 is applied to an alarm buzzer 100, to generate an audible alarm warning signal. Numeral 102 indicates a circuit for producing setting pulses PS in response to actuating pulses SW, which are very narrow pulses produced by differentiator circuit 46 as a result of actuation of external actuating member 40. As in the case of the circuit embodiment described with reference to FIG. 1 above, actuating member 40 is successively actuated by the timepiece user in order to perform setting of time.

Circuit block 57 serves to produce control signal Q2 which is applied to the JAM DATA terminal of down counter 48 in circuit block 102. The components and operation of circuit block 57 are identical to those of the circuit block designated by the same numeral in FIG. 1, which has been described above. In the case of circuit block 102, an AND gate 106 is incorporated, which is not used in the embodiment of FIG. 1. One input terminal of AND gate 106 receives SW actuating pulses from differentiator 46, and another input is connected to the 0 OUT terminal of down counter 48. Thus, once the 0 OUT terminal has been caused to go to the L level by application of an SW pulse through AND gate 106 to the JAM IN terminal, no further SW pulses will be applied to the JAM IN terminal until the 0 OUT terminal has again gone to the H level, i.e. until a number of pulses equal to the number stored into down counter 48 from the JAM DATA terminals has been applied to the clock terminal of down counter 48. Apart from the incorporation of AND gate 106, the components and operation of circuit block 102 are identical to those of the circuit shown in FIG. 1 for producing setting pulses PS, and comprising down counter 48, inverters 58 and 59, and AND gate 50. Thus, if we assume that counter 52 is a divide-by-four counter, as in the case of the embodiment of FIG. 1, then if the time intervals between successive actuations of actuating member 40 are less than the duration of four periods of signal C2, output Q2 will be at the H level. In this case, since a value of one will be read into down counter 48 from the JAM DATA terminals by the output of AND gate 106, each actuation of actuating member 40 will result in a single PS setting pulse being output from AND gate 50. Time setting can thus be performed gradually and precisely. If, on the other hand, actuating member 40 is actuated in rapid succession, then output Q2 will be at the L level, so that a value of 10 will be stored into down counter 48 from the JAM DATA terminals as a result of an output pulse from AND gate 106 applied to the JAM IN terminal. In this case, therefore, output 0 OUT of down counter 48 will remain at the L level until ten successive pulses have been applied to its clock input terminal from AND gate 50, and will then go to the H level, causing AND gate 50 to be inhibited by the L level output of inverter 59. Ten PS setting pulses will therefore be produced for each actuation of actuating member 40 in this case. Setting can therefore be performed rapidly and conveniently by the timepiece user actuating member 40 in rapid succession.

Although there have been previous designs proposed for an electronic timepiece having time indicating hands and also an alarm function, these designs have various disadvantages. These disadvantages include a lack of precision in setting an alarm time, or of having a complex structure which is difficult to manufacture. With the embodiment described above with reference to FIG. 3, an alarm time can be set, and an alarm signal subsequently generated, to a very high degree of precision. In addition, the alarm time is clearly displayed on electro-optical display 86, enabling the timepiece user to easily set in a new value of alarm time, and to immediately compare the alarm time which has been set with the current time, which is also displayed in digital form. And since the setting circuit of the present invention is utilized for setting both alarm time and the current time, setting can be performed very quickly in the initial stages, and can be performed more gradually and precisely when the desired value to be set in has almost been reached.

The embodiment shown in FIG. 3 can also be modified to include weekday, date and month counters, in addition to the hours and minutes counters. In this case, the weekday, date and month can be displayed by electro-optical display 86. This eliminates the difficulties which are encountered in providing a conventional type of electronic timepiece having time indicating hands with a means of indicating the weekday, date and month, without making the construction of the timepiece excessively large and complex.

Figure 4:
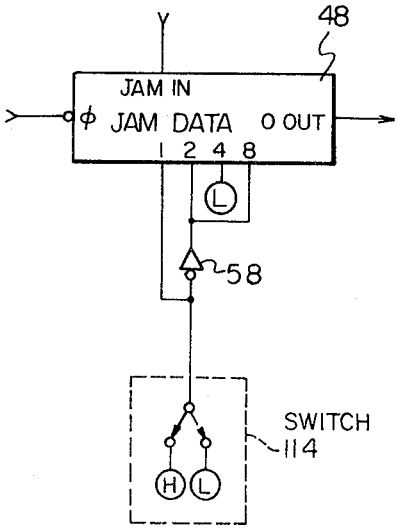
FIG. 4 is a partial block diagram illustrating a modification of the time setting circuit in accordance with the present invention shown in FIG. 3.

In the circuit embodiments of the present invention described above, the user can vary the number of setting pulses which are generated due to each actuation of the setting actuating member 40, by varying the rate at which he actuates that member. However it is possible to modify the present invention so that an additonal external actuating member is utilized, which actuates a switch in order to determine the number of setting pulses which will be generated by each actuation of the setting actuation member. This modification is illustrated in FIG. 4. In this case, detection circuit 57 shown in FIG. 1 and FIG. 3 is eliminated. The function of control signal Q2 supplied from detection circuit 57 is now performed by the output signal from a switch 114 which is coupled to an external actuating member. When this external actuating member is operated to set the output from switch 114 to the H level, when an H level input is applied to the JAM DATA input terminal of weight one, in down counter 48. As a result, only one setting pulse will be produced each that time setting actuating member 40 is actuated. If the external actuating member is operated to produce an L level output from switch 114, then H level inputs will be applied to JAM DATA inputs of weights 2 and 8 of down counter 48. In this case, ten setting pulses PS will be produced each time setting actuating member 40 is actuated. When switch 114 is set in one position, therefore, setting can be performed slowly and gradually. When switch 114 is set to its other position, setting can be performed rapidly.

Figure 5:
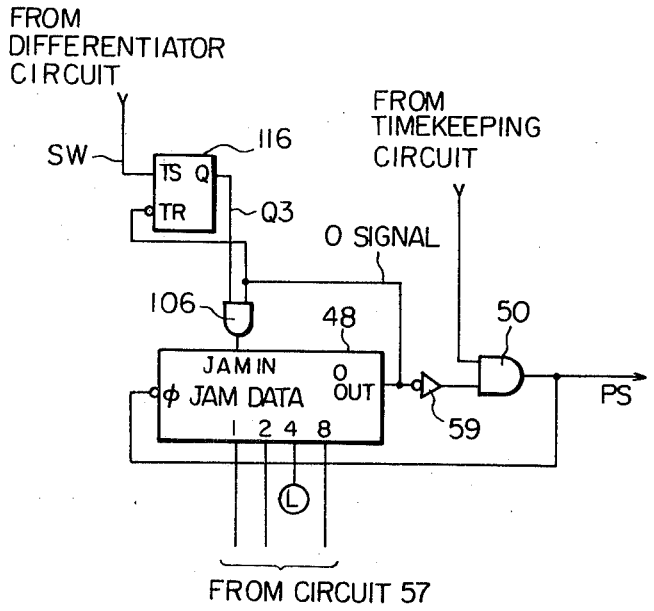
FIG. 5 is a partial block diagram illustrating another modification of the time setting circuit in accordance with the present invention.

FIG. 5 is a partial circuit diagram showing a modification of the setting pulse generation circuit 102 of the embodiment shown in FIG. 3 above. A trigger set-trigger reset type flip-flop 116 is additionally incorporated. Differentiated actuation signal SW is applied to the Set terminal of flip-flop 116. The output of the 0 OUT terminal of down counter 48 is applied to the reset terminal of flip-flop 116, which is an inverting input terminal. Output signal Q3 from flip-flop 116 is applied to an input of AND gate 106. If we assume that a series of setting pulses have been completely generated, as designated by the previous inputs to the JAM DATA terminals of down counter 48, then the 0 OUT terminal of down counter 48 goes from the L level to the H level. If a subsequent actuation pulse SW is generated, then this will cause flip-flop 116 to be set, so that output Q3 goes to the H level. An H level output is therefore applied to the JAM IN terminal of down counter 48. The 0 OUT terminal of down counter 48 will therefore go to the L level again, until the designated number of setting pulses PS have been output from AND gate 50 and applied to the clock terminal of down counter 48. When the designated number of setting pulses have been generated, then the 0 OUT terminal will go from the L level to the H level. Each time the 0 OUT terminal goes from the H level to the L level, flip-flop 116 is triggered into the reset condition, so that output Q3 goes to the L level, inhibiting AND gate 106. If an actuation pulse is generated before the designated number of setting pulses PS have been produced, then flip-flop 116 will be triggered into the set condition, so that output Q3 goes to the H level, but since the 0 OUT terminal is at the L level, no signal will be applied to the JAM IN terminal of down counter 48. Subsequently, when the designated number of setting pulses have been generated from AND gate 50, the 0 OUT terminal again goes to the H level, causing an H level signal to be applied to the JAM IN terminal of down counter 48 from AND gate 106. Another series of setting pulses will then be generated.

With the embodiment shown in FIG. 3, if an actuation pulse SW is generated while a designated number of setting pulses are still being produced as a result of a preceding actuation, then the actuation pulse SW will be ignored and have no effect. With the modification shown in FIG. 5 incorporated into the embodiment of FIG. 3, however, if an actuation pulse is generated while setting pulses are still being produced, then this actuation pulse is, in effect, memorized in flip-flop 116, and causes an input to be applied to the JAM IN terminal of down counter 48 when all of the designated number of setting pulses have been produced. Thus, even if the timepiece user actuates external actuating member 40 in a rapid manner, smooth setting can be attained.

Figure 6:
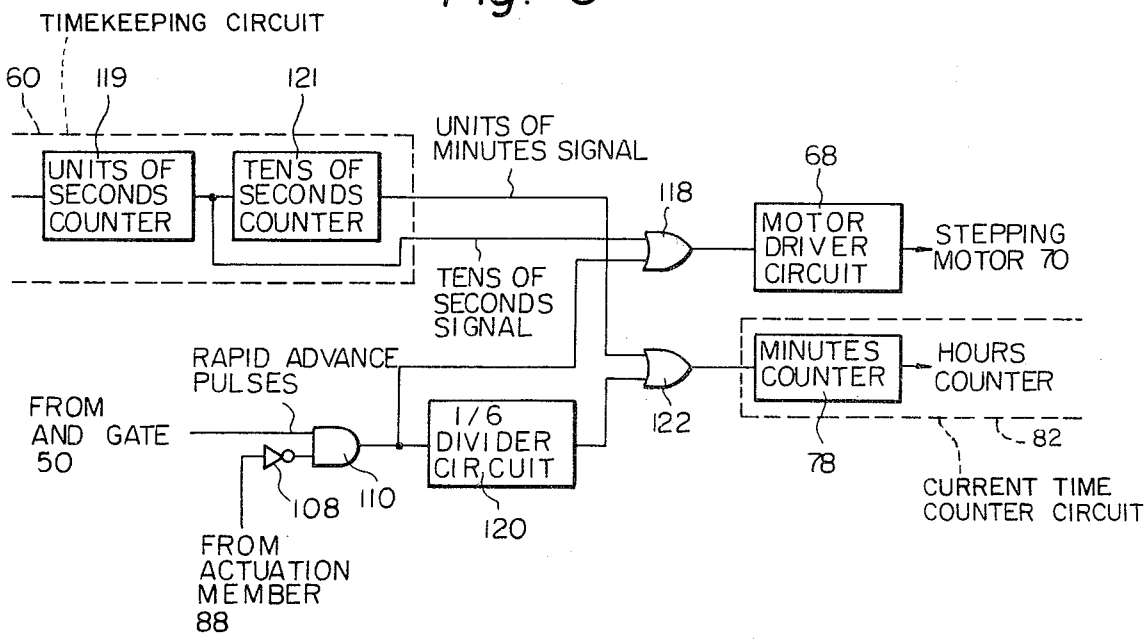
FIG. 6 is a partial block diagram illustrating a further modification of the time setting circuit in accordance with the present invention.

FIG. 6 is a partial circuit diagram of a modified form of the embodiment shown in FIG. 3. In the case of the embodiment shown in FIG. 3, stepping motor 70 causes minutes hand 74 to advance through an angle of 6° once per minute. Thus, the same signal, with a period of one minute, is applied from the output of OR gate 64 to motor drive circuit 68 and to minutes counter 78 of current time counter circuit 82. With the modified circuit shown in FIG. 6, however, the stepping motor 70 advances minutes hand 74 in steps of 1°, six times per minute. A signal having a period of 10 seconds is therefore applied from timekeeping circuit 60 to motor drive circuit 68 through OR gate 118. A signal having a period of one minute is applied through OR gate 122 to minutes counter 78 of current time counter circuit 82. In this case therefore, in order to perform setting of both time indicating hands 72 and 74 and the contents of current time counter circuit 82, it is necessary to apply setting pulses to motor drive circuit 68 at a rate which is six times that of the setting pulses applied to minutes counter 78. This is accomplished by means of a 1/6 divider circuit 120, connected between the output of AND gate 110 and an input of OR gate 122. With this arrangement, the movement of minutes hand 74 and of the contents of minutes counter 78 are maintained in synchronism when setting is performed, since minutes hand 74 is advanced through six 1° angles, corresponding to a change of the displayed time of one minute, for each setting pulse applied from OR gate 122 to minutes counter 78 of current time counter circuit 82. With the particular embodiment shown in FIG. 6, it is necessary that the number of setting pulses generated by each actuation of external actuation member 40 (when rapid setting is being performed so that multiple pulses are generated each time actuation is conducted) must be an integral multiple of six.

Figure 7:
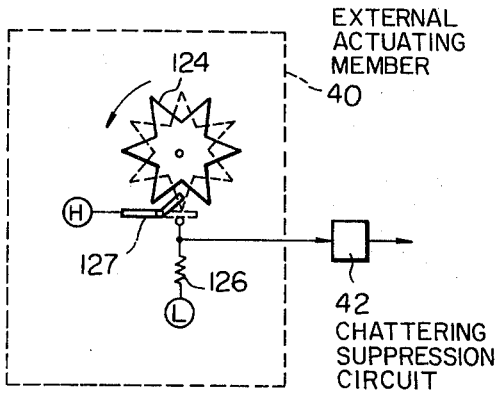
FIG. 7 is a diagram illustrating an embodiment of an external operating member for performing rapid setting of time in conjunction with the setting circuit of the present invention.

FIG. 7 shows an embodiment of external actuating member 40 shown in FIG. 1 and FIG. 3. The toothed wheel 124 can be coupled to the timepiece crown, to be rotated by the timepiece user in order to perform time setting. When toothed wheel 124 is in the position indicated by the full line outline, then switch contacts 127 are open, so that an output signal at the L level is applied to chattering suppression circuit 42. When toothed wheel 124 is rotated into the position indicated by the broken line outline, then switch contacts 127 are closed, so that an H level output signal is applied to chattering suppression circuit 42. In a mechanical type of timepiece in which time setting is performed by rotating the timepiece crown, it is possible to advance the displayed time by 55 minutes through a single rotation of the crown. If the external actuation member shown in FIG. 7 is utilized in the electronic timepiece embodiments illustrated in FIG. 1 or FIG. 3 above, then if toothed wheel 124 is rapidly rotated through one revolution by turning the timepiece crown, 51 setting pulses are generated. Use of such an actuating member as shown in FIG. 7 for time setting in an electronic timepiece employing a time setting circuit according to the present invention therefore can convey the impression to the user of setting a mechanical type of timepiece. Such a time setting arrangement therefore enables an electronic timepiece to be produced which conveys a feeling that is uniquely different from that provided by conventional types of electronic timepieces.

Alternatively, a pushbutton type of device can be utilized for actuating member 40.

It should also be noted that if the current time counter circuit 82 shown in the embodiment of FIG. 3 is utilized, then the output signal from hours counter 80 can be used to drive weekday, date and month counting means.

Furthermore, although the embodiments of FIG. 1 and FIG. 3 have been described on the assumption that one time setting pulse is produced for each actuation pulse which is generated, when actuating member 40 is actuated at a low repetition rate, while ten setting pulses are produced for each actuation pulse SW when actuating member 40 is actuated at a high repetition rate, these numbers of setting pulses can be freely modified. Also, although in the descriptions of the embodiment of FIG. 1 and FIG. 3 it has been assumed that counter circuit 52 is a divide-by-four counter, the division ratio of counter 52 can be freely modified as required. Further, while, in the embodiment of FIG. 1, the contents of the hours counter 18 has been described as being corrected by pulses SW, it may be corrected by a train of pulses PS.

Thus, although the present invention has been shown and described with reference to particular embodiments, it should be noted that various modifications may be made in these embodiments, without departing from the scope claimed for the present invention.

What is claimed is:

1. A time correction system for an electronic timepiece having a standard frequency, a frequency divider responsive to an output signal from said standard frequency to provide a standard time signal, timekeeping and time display means responsive to said standard time signal for recording and displaying time information, and setting circuit means coupled to said timekeeping and time display means for setting a desired value of said time information, comprising:

switch means to be actuated by an external actuating member for producing actuation pulses;

a setting pulse generation circuit responsive to each of said actuation pulses for producing at least one setting pulses to be applied to said timekeeping and time display means; and control signal generation means for generating a control signal to be applied to said setting pulse generation circuit to control the number of said setting pulses generated in response to each one of said actuation pulses;

said control signal generation means comprising a detection circuit means for detecting the duration of a time interval between at least two successive actuation pulses and for varying a logic level potential of said control signal in accordance with said duration of said time interval, whereby said control signal causes said setting pulse generation circuit to generate a first number of said setting pulses being greater than one in response to each of said actuation pulses when said detection circuit detects that said duration of a time interval between at least two successive actuation pulses is less than a predetermined value, and whereby said control signal causes said setting pulse generation circuit to generate a second number of said setting pulses being less than said first number of said setting pulses in response to each of said actuation pulses when said detection circuit detects that said duration of a time interval between at least two successive actuation pulses is greater than said predetermined value.

2. A time correction system according to claim 1, wherein said setting pulse generation circuit includes a presettable counter, and whereby a count value designating a number of setting pulses to be subsequently generated is set into said presettable counter by each of said actuation pulses, the magnitude of said count value being preset by said control signal.

3. A time correction system according to claim 1, wherein said frequency divider also provides clock pulses, and wherein said detection circuit means comprises:

a counter circuit having a clock terminal to receive said clock pulses from said frequency divider, a reset terminal connected to said actuation pulses, and an output terminal, whereby said output terminal changes in potential when a predetermined number of said clock pulses have been applied to said clock terminal;

a first data-type flip-flop having a clock terminal coupled to said output terminal of said counter circuit, a reset terminal coupled to said actuation pulses, and an output terminal;

a second data-type flip-flop having a clock terminal connected to said actuation pulses, a data terminal connected to said output terminal of said first data-type flip-flop, and an output terminal for providing said control signal to said setting pulse generation circuit.

4. A time correction system according to claim 1, wherein said control signal generation means comprises a switch arranged for generating said control signal.

5. A time correction system according to claim 1 or 4, wherein said timekeeping and time display means comprises at least a minutes counter circuit for counting said standard time signal from said frequency divider and an hours counter circuit for counting an output with of said minutes counter circuit, together electro-optical display means for displaying contents of said hours and minutes counter circuits, and further comprising selection and gating means for applying said setting pulses to either said minutes or said hours counter to set the contents thereof.

6. A time correction system according to claim 1 or 4, wherein said timekeeping and time display means comprise a motor drive circuit responsive to said standard time signal from said frequency divider, a stepping motor driven by said motor drive circuit in accordance with said standard time signal, and time indicating hands driven by said stepping motor, and further comprising first gate means having an output coupled to an input terminal of said motor drive circuit and having input terminals to receive said setting pulses and said standard time signal, for applying said setting pulses and said standard time signal to said motor drive circuit.

7. A time correction system according to claim 6, and further comprising:

a current time counter circuit comprising at least a minutes counter having an input terminal coupled to the output of said first gate means and an hours counter to receive an output signal from said minutes counter;

an alarm memory circuit comprising at least a minutes memory circuit and an hours memory circuit;

an alarm time coincidence detection circuit to compare the contents of said current time counter circuit and of said alarm memory circuit and for generating an alarm coincidence signal when coincidence is detected between said contents of said current time counter circuit and of said alarm memory circuit;

alarm warning means for generating a warning signal in response to said alarm coincidence signal;

display driver circuit means to receive output signals from said current time counter circuit and said alarm memory circuit and for thereby producing display drive signals;

electro-optical display means driven by said display drive signals for displaying the contents of said current time counter circuit and of said alarm memory circuit;

another switch means for generating a setting selection signal;

second gate means to receive said setting selection signal and said setting pulses and having an output terminal connected to one of the input terminals of said first gate means; and third gate means to receive said setting selection signal and said setting pulses and having an output terminal connected to said alarm memory circuit.

8. A time correction system according to claim 2, wherein said frequency divider also provides clock pulses, and wherein said detection circuit means comprises:

a counter circuit having a clock terminal to receive said clock pulses from said frequency divider, a reset terminal connected to said actuation pulses, and an output terminal, whereby said output terminal changes in potential when a predetermined number of said clock pulses have been applied to said clock terminal;

a first data-type flip-flop having a clock terminal coupled to said output terminal of said counter circuit, a reset terminal coupled to said actuation pulses, and an output terminal;

a second data-type flip-flop having a clock terminal connected to said actuation pulses, a data terminal connected to said output terminal of said first data-type flip-flop, and an output terminal for providing said control signal.

9. A time correction system according to claim 2, wherein said timekeeping and time display means comprises at least a minutes counter circuit for counting said standard time signal and an hours counter circuit for counting an output signal of said minutes counter circuit, together with electro-optical display means for displaying contents of said hours and minutes counter circuits, and further comprising selection and gating means for applying said setting pulses to either said minutes or said hours counter to set the contents thereof.

10. A time correction system according to claim 2, wherein said timekeeping and time display means comprises at least a minutes counter circuit for counting said standard time signal and an hours counter circuit for counting an output signal of said minutes counter circuit, together with electro-optical display means for displaying contents of said hours and minutes counter circuits, and further comprising selection and gating means for applying said setting pulses to either said minutes or said hours counter to set the contents thereof.

11. A time correction system according to claim 2, wherein said timekeeping and time display means comprise a motor drive circuit responsive to said standard time signal, a stepping motor driven by said motor drive circuit in accordance with said standard time signal, and time indicating hands driven by said stepping motor, and further comprising first gate means having an output coupled to an input terminal of said motor drive circuit and having input terminals to receive said setting pulses and said standard time signal, for applying said setting pulses and said standard time signal to said motor drive circuit.

12. A time correction system according to claim 1, wherein said timekeeping and time display means comprises a motor drive circuit responsive to said standard time signal, a stepping motor driven by said motor drive circuit in accordance with said standard time signal, and time indicating hands driven by said stepping motor, and further comprising first gate means having an output coupled to an input terminal of said motor drive circuit and having input terminals to receive said setting pulses and said standard time signal, for applying said setting pulses and said standard time signal to said motor drive circuit.

* * * * *